US007385354B2

(12) United States Patent
Miyake

(10) Patent No.: US 7,385,354 B2
(45) Date of Patent: Jun. 10, 2008

(54) MULTI-BEAM KLYSTRON APPARATUS

(75) Inventor: Setsuo Miyake, Nasushiobara (JP)

(73) Assignees: Toshiba Electron Tubes & Devices Co., Ltd., Tokyo (JP); Kabushiki Kaisha Toshiba, Tokyo (JP)

( * ) Notice: Subject to any disclaimer, the term of this patent is extended or adjusted under 35 U.S.C. 154(b) by 5 days.

(21) Appl. No.: 11/606,026

(22) Filed: Nov. 30, 2006

(65) Prior Publication Data

US 2008/0100384 A1 May 1, 2008

(30) Foreign Application Priority Data

Nov. 30, 2005 (JP) ..... 2005-346046

(51) Int. Cl.
*H01J 25/10* (2006.01)
*G21K 1/08* (2006.01)

(52) U.S. Cl. ..... 315/5.39; 315/3; 315/501; 250/396 R

(58) Field of Classification Search ..... 315/3, 315/5, 5.35, 5.37–5.39, 5.41, 500, 501, 507; 250/396 R, 423 R, 398, 492.3; 313/356, 313/364, 409, 411
See application file for complete search history.

(56) References Cited

U.S. PATENT DOCUMENTS

| | | | | |
|---|---|---|---|---|
| 5,773,934 | A * | 6/1998 | Uhm | 315/5.39 |
| 6,326,730 | B1 * | 12/2001 | Symons | 315/5.39 |
| 6,495,953 | B1 * | 12/2002 | Imura | 313/448 |
| 6,847,168 | B1 * | 1/2005 | Ives et al. | 315/5.14 |
| 7,116,064 | B1 * | 10/2006 | Bluem | 315/500 |
| 2002/0008478 | A1 * | 1/2002 | Schult | 315/5.37 |
| 2002/0180362 | A1 * | 12/2002 | Symons | 315/3 |
| 2003/0038603 | A1 * | 2/2003 | Mako et al. | 315/382.1 |

FOREIGN PATENT DOCUMENTS

JP 2002-520772 7/2002

* cited by examiner

*Primary Examiner*—Thuy V. Tran
*Assistant Examiner*—Tung X Le
(74) *Attorney, Agent, or Firm*—Pillsbury Winthrop Shaw Pittman, LLP

(57) ABSTRACT

A multi-beam klystron apparatus is disclosed. A radio-frequency interaction unit pole piece is arranged between a main magnetic field generator and an output-side magnetic field generator. The magnetic circuit formed in the neighborhood of an output cavity of a radio-frequency interaction unit is separated from the magnetic circuit of the main magnetic field generator by the radio-frequency interaction unit pole piece. The output-side magnetic field generator increases the axial magnetic flux density in the neighborhood of the output cavity without curving the electron beams and thus prevents the spread of the electron beams in the neighborhood of the output cavity.

4 Claims, 13 Drawing Sheets

MULTI-BEAM KLYSTRON APPARATUS

CROSS-REFERENCE TO RELATED APPLICATIONS

This application is based upon and claims the benefit of priority from prior Japanese Patent Application No. 2005-346046, filed Nov. 30, 2005, the entire contents of which are incorporated herein by reference.

BACKGROUND OF THE INVENTION

1. Field of the Invention

This invention relates to a multi-beam klystron apparatus for amplifying radio-frequency power.

2. Description of the Related Art

The conventional klystron apparatus includes an electron gun unit for generating an electron beam, an input unit for inputting radio-frequency power, a radio-frequency interaction unit for amplifying the radio-frequency power by the interaction between the electron beam and the radio-frequency electric field, an output unit for outputting the radio-frequency power from the radio-frequency interaction unit, a klystron body having a collector unit for capturing the used electron beam having passed through the radio-frequency interaction unit, and a focusing magnetic field unit mounted on the klystron body for focusing the electron beams. The radio-frequency interaction unit includes drift tubes through which the electron beams pass, an input cavity connected to the drift tubes along the direction in which the electron beams proceed and a plurality of intermediate and output cavities, wherein the input cavity is connected with the input unit and the output cavity with the output unit.

FIG. 10 shows the result of analyzing the lines of magnetic force of a focusing magnetic field unit of the single-beam klystron apparatus. In many actual cases, a focusing magnetic field unit 1 includes several to ten and several electromagnets 2*a*, 2*b* arranged along the collector unit from the electron gun unit side of the klystron body and a magnetic pole 3 having an electron gun-side pole piece 3*a*, a collector-side pole piece 3*b* and a return frame 3*c*. In this focusing magnetic unit 1, the electron beam is focused by the magnetic field generated by the current supplied to the electromagnets 2*a*, 2*b*. In FIG. 10, the electron gun unit is arranged on the lower side, and the collector unit on the upper side. Reference numeral 4 designates lines of magnetic force, which are too thin and not shown in the magnetic pole 3.

Generally, the electron beam of the klystron apparatus, in the absence of radio frequency, has a substantially constant thickness. In the radio-frequency operation, however, the electron beams are bunched progressively downstream in the direction of radiation and, in the neighborhood of the output cavity, the degree of density thereof comes to be clearly defined. At points where electron density is high, the electron beam tends to spread diametrically due to the reaction of the electrons due to the space charge thereof. For this reason, a method is employed in which the radius of the drift tube surrounding the electron beam is increased to prevent collision or the axial magnetic flux density of the focusing magnetic field in the neighborhood of the output cavity is increased to suppress the spread of the electron beam. The method of simply increasing the radius of the drift tube, however, encounters the problem of a reduced output conversion efficiency, and therefore a method is generally employed in which the axial magnetic flux density of the focusing magnetic field is increased in the neighborhood of the output cavity.

FIG. 11 is a graph showing the relation between the axial position from the cathode (position 0 of the distance Z) of the electron gun unit of the single-beam klystron apparatus and the axial magnetic flux density. The magnetic field is formed in the same direction from the cathode of the electron gun unit to the collector unit, and the axial magnetic flux density is 680 Gauss in the neighborhood of the input cavity while it is 820 Gauss, or 20% higher, in the neighborhood of the output cavity. The electron beam is focused in such a manner as to be wound on the lines of magnetic force and therefore an effective means for preventing the dispersion of the electron beam is provided by increasing the axial magnetic flux density in the neighborhood of the output cavity with the electron beam more bunched.

FIG. 12 is a graph showing the relation between the axial position (distance Z) from the cathode of the electron gun unit of the single-beam klystron apparatus and the lines of magnetic force at the radius R in the neighborhood of the center axis. It is understood that the electron beam having the radius indicated by the second lowest line, for example, proceeds along the lines of magnetic force and therefore the radius thereof is reduced from 7 mm in the neighborhood of the input cavity to 6.3 mm in the neighborhood of the output cavity.

Also, it is generally known in this particular field of technique that the lower the ratio of the beam current to the beam voltage called the perveance, the higher the output conversion efficiency of the klystron apparatus. Also, one of the means for improving the efficiency is known to be provided by a multi-beam klystron apparatus in which the number of electron beams is increased from one to several or several tens and the perveance of each electron beam is set low to suppress the beam voltage applied to the electron gun unit while at the same time improving the overall output conversion efficiency (Jpn. PCT National Publication No. 2002-520772).

In the multi-beam klystron apparatus, several to several tens of electron beams are arranged at a distance from the center axis of the klystron apparatus. For example, electron beams are arranged at intervals of 60 degrees at the distance of 60 mm from the center axis of the body of the klystron apparatus.

In this multi-beam klystron apparatus, an increase in the axial magnetic flux density in the neighborhood of the output cavity to suppress the spread of the electron beam, like in the single-beam klystron apparatus, would pose the problem that the lines of magnetic force are curved and so are the electron beams. This is specifically explained with reference to the graph of FIG. 13 showing the relation between the axial position (distance Z) from the cathode of the electron gun unit of the multi-beam klystron apparatus and the lines of magnetic force at the position (radius R) from the center axis of the klystron body in the neighborhood of each electron beam. In the case of the electron beam having the center axis indicated by the second lowest line, for example, the center axis of the electron beam is located at the distance of 60 mm from the center axis of the klystron body in the neighborhood of the input cavity, while the center axis of the electron beam is moved to the point at the distance of 54 mm from the center axis of the klystron body in the neighborhood of the output cavity, thereby curving the electron beam. Under this condition, the electron beam would impinge on the drift tube and therefore it is impossible to assure stable operation of the multi-beam klystron apparatus by increasing the axial magnetic flux density in the neighborhood of the output cavity.

In the case where the output unit such as the waveguide or the coaxial tube output unit connected to the output cavity is led out substantially at right angles to the center axis of the klystron body, on the other hand, a focusing magnet may not be arranged at the particular location. In such a case, the axial magnetic flux density is reduced in the neighborhood of the output cavity. This curves the lines of magnetic force at other than the center axis of the klystron body, with the result that the electron beam is curved in the multi-beam klystron apparatus in which the electron beam passes a point distant from the center axis of the klystron body.

BRIEF SUMMARY OF THE INVENTION

This invention has been achieved in view of this situation, and the object thereof is to provide a multi-beam klystron apparatus in which the axial magnetic flux density in the neighborhood of the output cavity can be increased without curving the electron beam.

A multi-beam klystron apparatus of the present invention comprises: an electron gun unit which generates electron beams from a plurality of points; an input unit which inputs radio-frequency power; a radio-frequency interaction unit which includes, from the electron gun unit side, an input cavity, a plurality of intermediate cavities and an output cavity, and amplifies the radio-frequency power input from the input unit to the input cavity by the interaction between the electron beams generated in the electron gun unit and a radio-frequency electric field; an output unit which outputs the radio-frequency power from the output cavity of the radio-frequency interaction unit; a collector unit which captures the electron beams passing through the radio-frequency interaction unit; and a focusing magnetic field unit which focuses the electron beams generated by the electron gun unit, the focusing magnetic field unit including: a main magnetic field generator arranged on the outside of the input cavity and the intermediate cavities of the radio-frequency interaction unit; an output-side magnetic field generator arranged on the outside of the output cavity of the radio-frequency interaction unit; an electron gun-side pole piece arranged between the radio-frequency interaction unit and the electron gun unit; a collector-side pole piece arranged between the radio-frequency interaction unit and the collector unit; and a radio-frequency interaction unit pole piece arranged between the output-side magnetic field generator and the main magnetic field generator.

According to this invention, there is provided a multi-beam klystron apparatus in which a pole piece in a radio-frequency interaction unit (radio-frequency interaction unit pole piece) is arranged between an output magnetic field generator and a main magnetic field generator thereby to separate the magnetic circuit in the neighborhood of the output cavity of the radio-frequency interaction unit. Therefore, the axial magnetic flux density can be increased in the neighborhood of the output cavity without curving the electron beam so that the spread of the electron beams in the neighborhood of the output cavity can be prevented.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of this invention will be explained below with reference to the accompanying drawings.

FIGS. 1 to 8 show a first embodiment of the invention.

Figure 1:
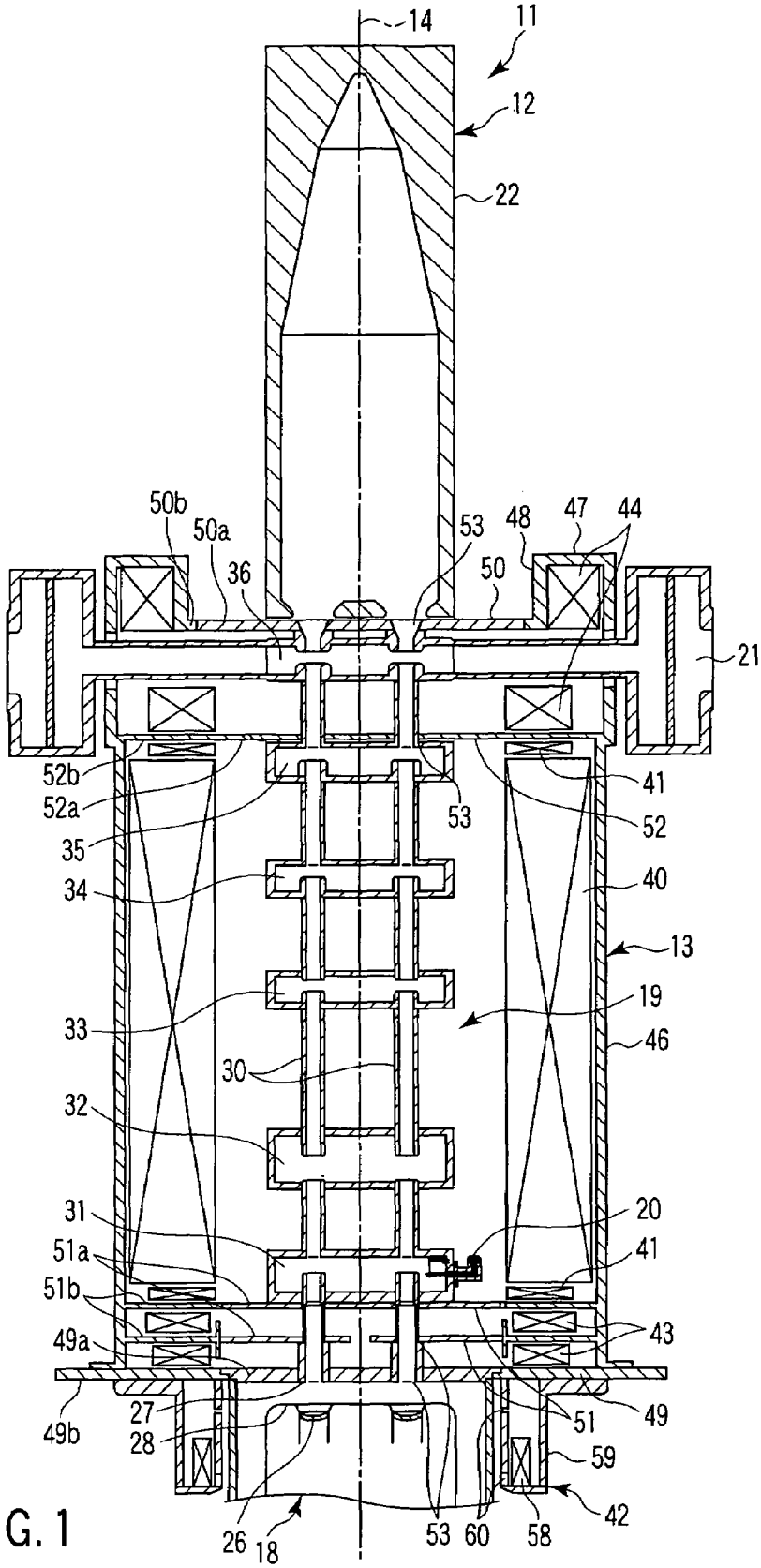
FIG. 1 is a sectional view of a multi-beam klystron apparatus according to a first embodiment of the invention.

As shown in FIG. 1, a multi-beam klystron apparatus 11 includes a klystron body 12 and a focusing magnetic field unit 13. In FIG. 1, reference numeral 14 designates the center axis of the multi-beam klystron apparatus 11.

Figure 2:
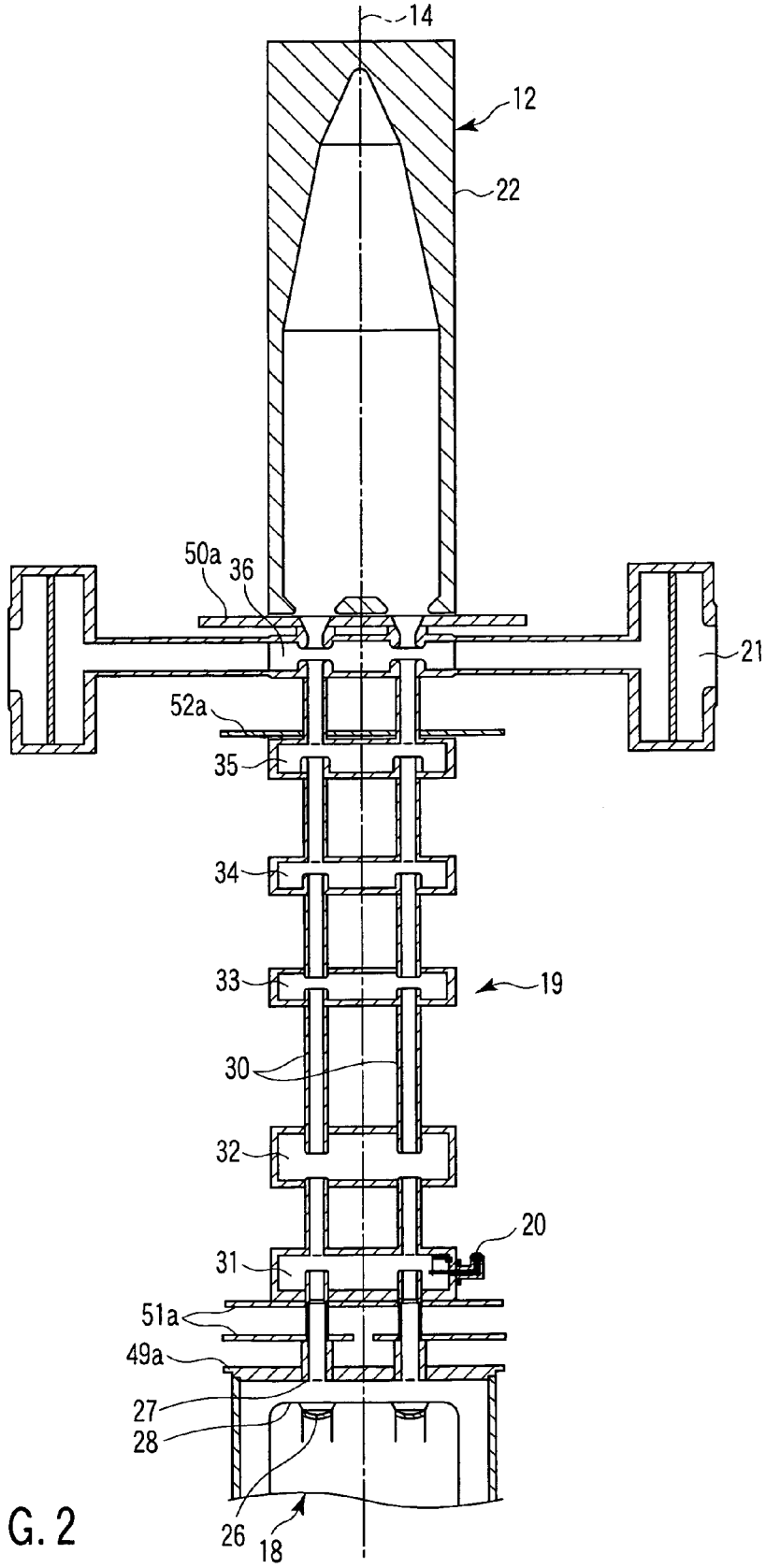
FIG. 2 is a sectional view showing the klystron body of the same multi-beam klystron apparatus.

As shown in FIG. 2, the klystron body 12 includes an electron gun unit 18 for generating electron beams from a plurality of points, a radio-frequency interaction unit 19 for amplifying the radio-frequency power by the interaction between the electron beams and the radio-frequency electric field, an input unit 20 for inputting the radio-frequency power to the radio-frequency interaction unit 19, an output unit 21 for outputting the radio-frequency power from the radio-frequency interaction unit 19, and a collector unit 22 for capturing only the used electron beams having passed through the radio-frequency interaction unit 19.

The electron gun unit 18 includes a plurality of cathodes 26 arranged on the circumference around the center axis 14 and generating electron beams. An anode 27 is arranged in opposed relation to each cathode 26. A focusing electrode 28 to focus the electron beams is arranged around the cathodes 26.

The radio-frequency interaction unit 19 includes a plurality of drift tubes 30 arranged on the circumference around the center axis 14 and allowing the electron beams to pass therethrough, respectively, an input cavity 31 connected to each drift tube 30 along the direction in which the electron beams proceed, a plurality of intermediate cavities 32, 33, 34, 35 and an output cavity 36. The input unit 20 is connected to the input cavity 31, and the output unit 21 is connected to the output cavity 36.

Figure 3:
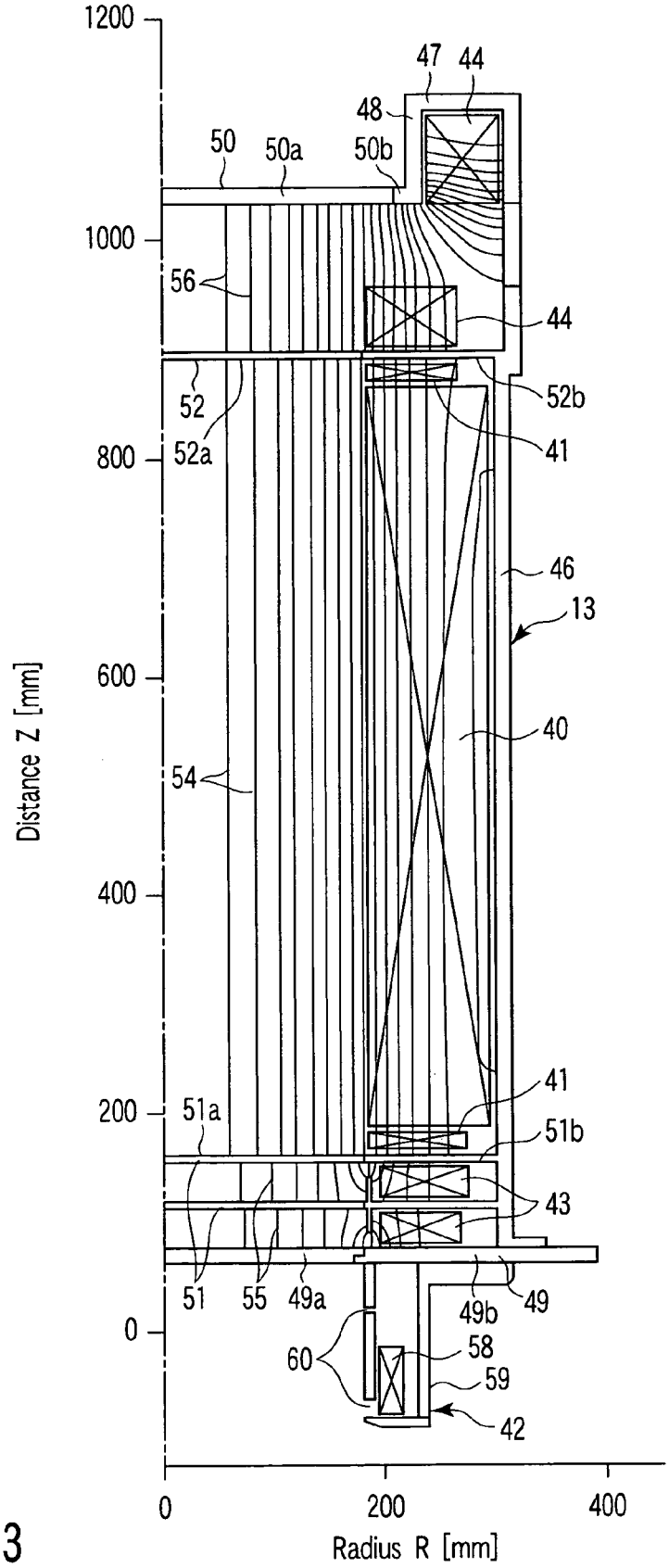
FIG. 3 is a diagram for explaining the result of analyzing the lines of magnetic force of the focusing magnetic field unit of the same multi-beam klystron apparatus.

Next, as shown in FIGS. 1 and 3, the focusing magnetic field unit 13 has arranged thereon an axially long main magnetic field generator 40 around the input cavity 31 and the plurality of the intermediate cavities 32 to 35 of the radio-frequency interaction unit 19. A lateral magnetic field-suppressing magnetic field generator 41 is arranged at each axial end of the main magnetic field generator 40. An electron gun-side magnetic field generator 42 is arranged on the outside of the electron gun unit 18 at an end of the main magnetic field generator 40. A plurality of electron beam trajectory-correcting magnetic field generators 43 are arranged between the main magnetic field generator 40 and the electron gun-side magnetic field generator 42. An output-side magnetic field generator 44 is arranged on the outside of the output cavity 36 of the radio-frequency interaction unit 19 at the other end of the main magnetic field generator 40. The output-side magnetic field generator 44 is separated on both sides of the axis of the output cavity 36 circumventing the output unit 21 including a coaxial tube output unit or a waveguide connected to the output cavity 36 in the direction substantially perpendicular to the center axis 14 of the klystron body 12. The magnetic field generators 40 to 44 are each configured of an electromagnet including a coil through which a current is supplied for generating the magnetic field.

An outer peripheral magnetic pole 46 is arranged on the outer periphery of the magnetic field generators 40 to 44. An end surface magnetic pole 47 is arranged on the end surface on the collector unit 22 side, and an inner peripheral magnetic pole 48 is arranged on the inside of the end surface magnetic pole 47. These magnetic poles 46 to 48 make up a return frame. An electron gun-side pole piece 49 is arranged between the radio-frequency interaction unit 19 and the electron gun unit 18. A collector-side pole piece 50 is arranged between the radio-frequency interaction unit 19 and the collector unit 22. An electron beam trajectory correcting-auxiliary pole piece 51 is arranged between the main magnetic field generator 40, the lateral magnetic field-suppressing magnetic field generator 41 and the intermediate cavity 32 on the one hand and the electron beam trajectory-correcting magnetic field generator 43 on the other hand and also between the two electron beam trajectory-correcting magnetic field generators 43. A radio-frequency interaction unit pole piece 52 is arranged between the main magnetic field generator 40, the lateral magnetic field-suppressing magnetic field generator 41 and the intermediate cavity 35 on the one hand and the output-side magnetic field generator 44 and the output cavity 36 on the other hand. The magnetic poles 46 to 48 and the pole pieces 49 to 52 are formed of a magnetic material and generate therein the magnetic field of each of the magnetic field generators 40 to 44.

The pole pieces 49 to 52 each form a discal magnetic pole configured of each of the pole pieces 49*a* to 52*a* arranged on the focusing magnetic field unit 13 and each of the pole pieces 49*b* to 52*b* arranged on the klystron body 12. The pole pieces 49 to 52 are each formed with a plurality of holes 53 on the circumference around the center axis 14, through which each electron beam passes.

FIG. 3 is a diagram for explaining the result of analyzing the lines of magnetic force of the focusing magnetic field unit 13 of the multi-beam klystron apparatus 11, in which the abscissa represents the radial distance (radius R) with the center axis 14 of the klystron body 12 as zero and the ordinate the distance Z in axial direction with the design center coordinate of the cathode 26 as zero. Numeral 54 designates the lines of magnetic force generated in the main magnetic field generator 40 and the lateral magnetic field-suppressing magnetic field generator 41, numeral 55 the lines of magnetic force generated in the electron beam trajectory-correcting magnetic field generator 43, and numeral 56 the lines of magnetic force generated in the output-side magnetic field generator 44. The lines of magnetic force 54 generated in the main magnetic field generator 40 and the lines of magnetic force 56 generated in the output-side magnetic field generator 44 are formed in the same direction. The lines of magnetic force generated in the electron gun-side magnetic field generator 42 are not shown.

Also, the electron gun-side magnetic field generator 42 is arranged on the outside of the electron gun-side pole piece 49, and configured of, for example, one auxiliary magnet 58 formed of an electromagnet including a coil. This auxiliary magnet 58 is surrounded by the electron gun-side magnetic pole 59 configured of a magnetic material coupled to the electron gun-side pole piece 49. The electron gun-side magnetic pole 59 has an outer peripheral magnetic pole, an inner peripheral magnetic pole and magnetic poles at axial ends, and the inner peripheral surface of the electron gun-side magnetic pole 59 is formed with two axial magnetic gaps 60 corresponding to the direction in which the electron beams proceed.

Now, the operation of the multi-beam klystron apparatus 11 is explained.

In the multi-beam klystron apparatus 11, a plurality of electron beams are generated at points displaced from the center axis 14 of the focusing magnetic field unit 13. At a point displaced from the center axis 14, lateral magnetic fields are generated in addition to axial magnetic fields, and therefore the electron beam is liable to be curved at the ends of the main magnetic field generator 40. In order to suppress this lateral magnetic field, the lateral magnetic field-suppressing magnetic field generator 41 high in current density is arranged at each end of the axially long main magnetic field generator 40. Thus, the lines of magnetic force 54 parallel to the center axis 14 of the klystron body 12 are formed on the inside of the inner diameter of the main magnetic field generator 40.

Also, in order to suppress the spread of the electron beam in the neighborhood of the output cavity 36, the output-side magnetic field generator 44 is arranged.

The radio-frequency interaction pole piece 52 arranged between the main magnetic field generator 40 and the output-side magnetic field generator 44 is shielded to prevent the magnetic field generated in the main magnetic field generator 44 from leaking to the neighborhood of the output cavity 36 on the one hand while at the same time preventing the magnetic field generated in the output-side magnetic field generator 44 from leaking to the area in the front intermediate cavity 35.

The axial distance between the collector-side pole piece 50 and the radio-frequency interaction unit pole piece 52 is comparatively small, and therefore the lines of magnetic force 56 generated in the output-side magnetic field generator 44 remain parallel with the center axis 14 of the klystron body 12 on the inside of the inner diameter of the output-side magnetic field generator 44 even if the axial magnetic flux density is increased.

Figure 4:
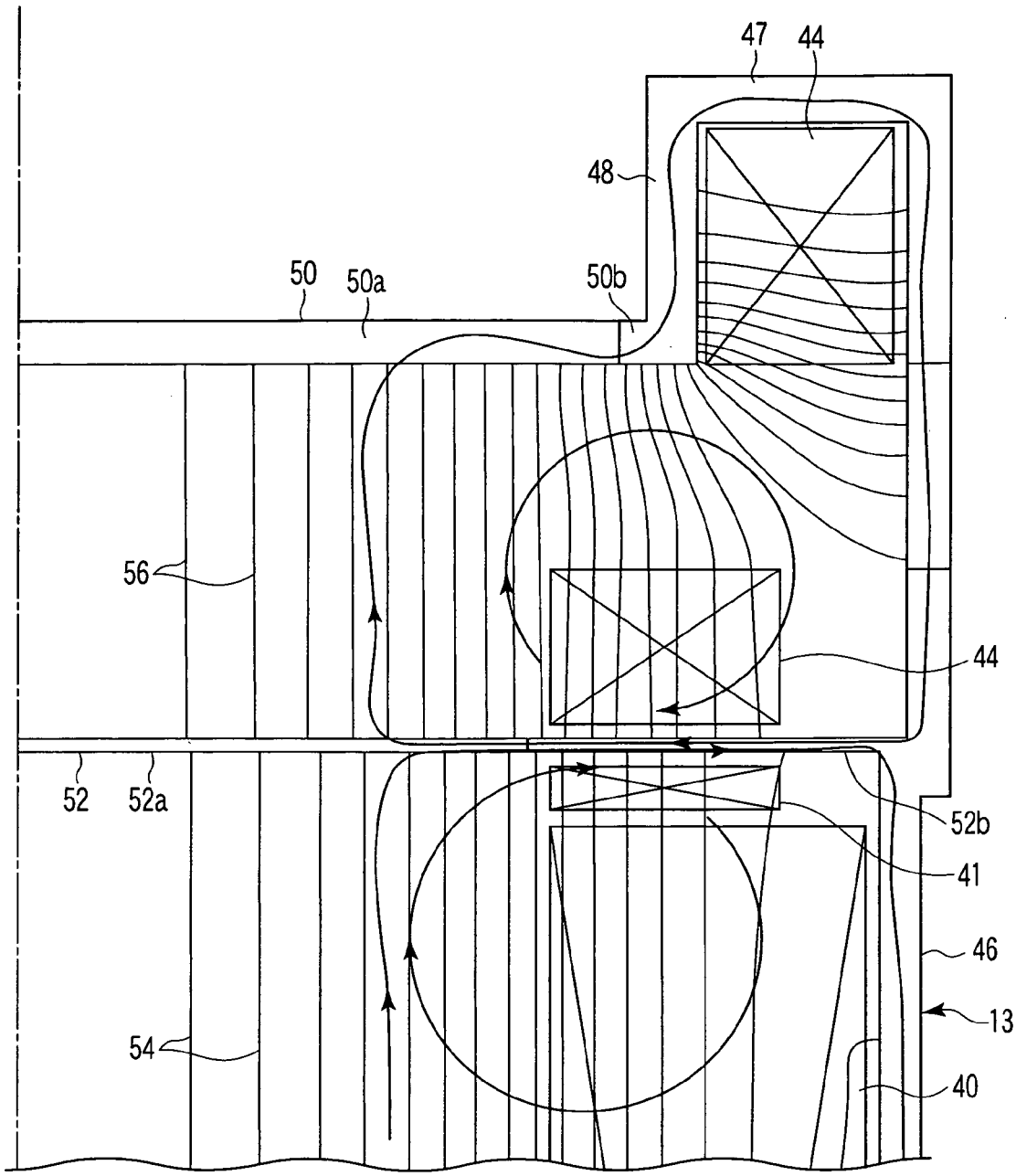
FIG. 4 is a partially enlarged view for explaining the same focusing magnetic field unit.

As shown in FIG. 4, the lines of magnetic force 54 generated in the main magnetic field generator 40 and the lines of magnetic force 56 generated in the output-side magnetic field generator 44 have the same direction, while they are opposite to each other in direction in the radio-frequency interaction unit pole piece 52. Thus, only the lines of magnetic force equal to the difference after being offset by each other passes through the radio-frequency interaction unit pole piece 52, and therefore the thickness of the radio-frequency interaction unit pole piece 52 can be decreased.

Also, the electron gun-side magnetic field generator 42 includes two magnetic gaps 60 formed so that the lines of magnetic force locally leak along the center axis and the lines of magnetic force in the neighborhood of the cathode 26 are parallel to the center axis 14. By using the following electron beam trajectory-correcting magnetic field generator 43, the radius of the electron beam is regulated and ripples corrected thereby to produce a beautiful electron beam.

The pole pieces 49 to 52 each have a hole 53 through which the electron beam passes. Since this hole 53 may have the minimum radius to pass the electron beam, however, the magnetic field leaking out of the hole has substantially no effect on the other electron beams.

By separating the main magnetic field generator 40 and the lateral magnetic field-suppressing magnetic field generator 41, the electron gun-side magnetic field generator 42, the electron beam trajectory-correcting magnetic field generator 43 and the output-side magnetic field generator 44 from each other by the pole pieces 49, 51, 52, the mutual effect is greatly reduced and each unit can generate the lines of magnetic force parallel to the center axis 14 independently.

Figure 5:
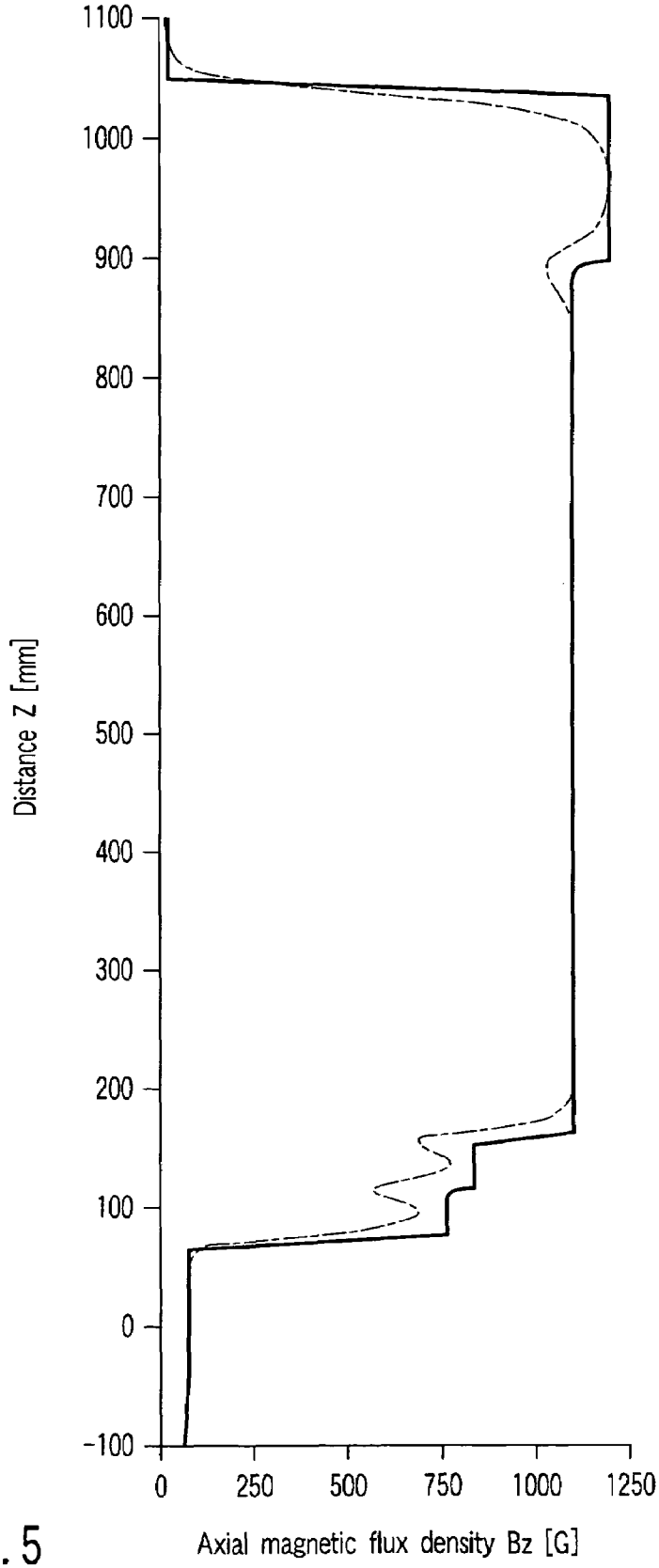
FIG. 5 is a graph showing the relation between the axial magnetic flux density and the axial position from the cathode of the electron gun unit of the same multi-beam klystron apparatus.

FIG. 5 shows the distribution of the axial magnetic flux density of the focusing magnetic field unit 13 of FIG. 3, and the relation between the axial magnetic flux density and the axial position (distance Z) from the cathode 26 of the electron gun unit 18. The dashed line indicates the distribution of axial magnetic flux density on the electron beam axis, and the solid line the distribution of axial magnetic flux density at a point 30 degrees displaced from the electron beam axis on the radius from the center axis 14 to the electron beam axis. The axial magnetic flux density remains unchanged and the lines of magnetic force are parallel for other than the pole pieces 49 to 52.

Figure 6:
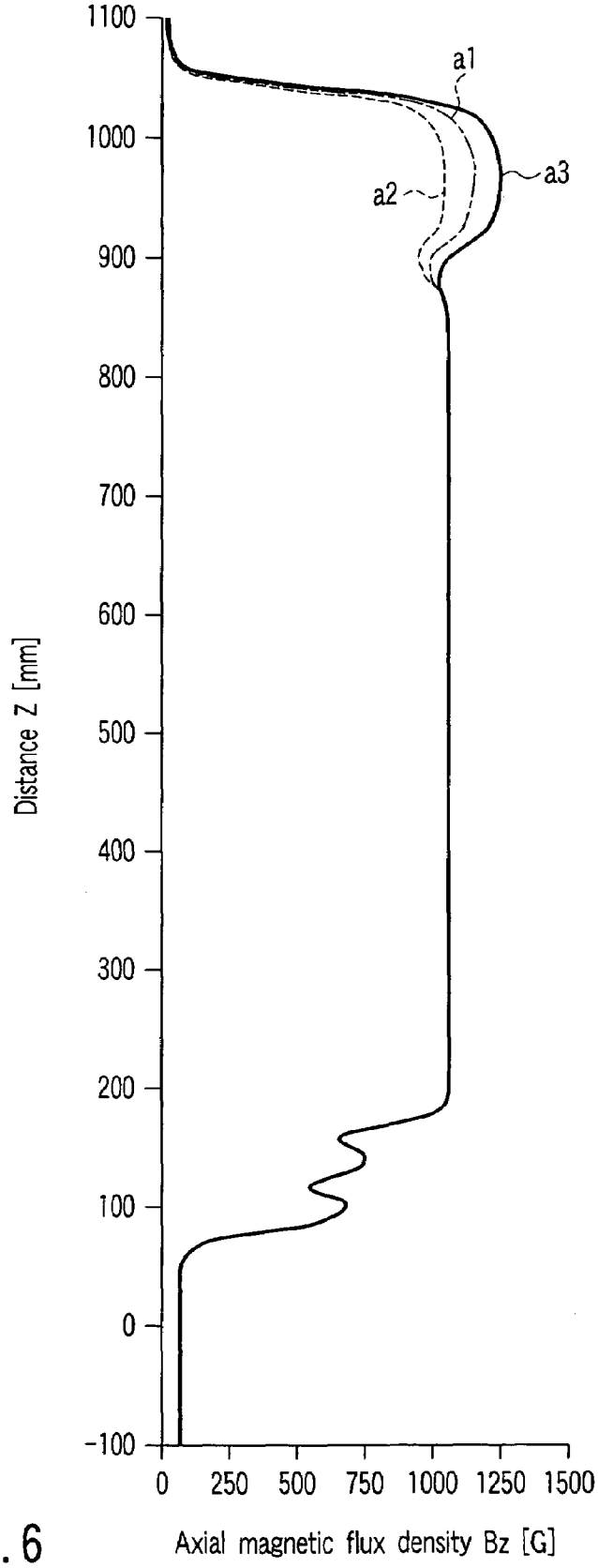
FIG. 6 is a graph showing the relation between the axial magnetic flux density and the axial position from the cathode of the electron gun unit with a changing current flowing in the output-side magnetic field generator of the same multi-beam klystron apparatus.

FIG. 6 shows the relation between the axial magnetic flux density and the axial position (distance Z) from the cathode 26 of the electron gun unit 18 in the case where the current flowing in the output-side magnetic field generator 44 is changed in value. The magnetic flux density distribution on the electron beam axis is shown for the case a1 in which the value of the current flowing in the output-side magnetic field generator 44 is equal to a reference current, the case a2 in which it is equal to 90% of the reference current, and the case a3 in which it is equal to 110% of the reference current. It is understood that the magnetic field leaking from the hole 53 of the radio-frequency interaction unit pole piece 52 is so small that only the output magnetic field changes.

Figure 8:
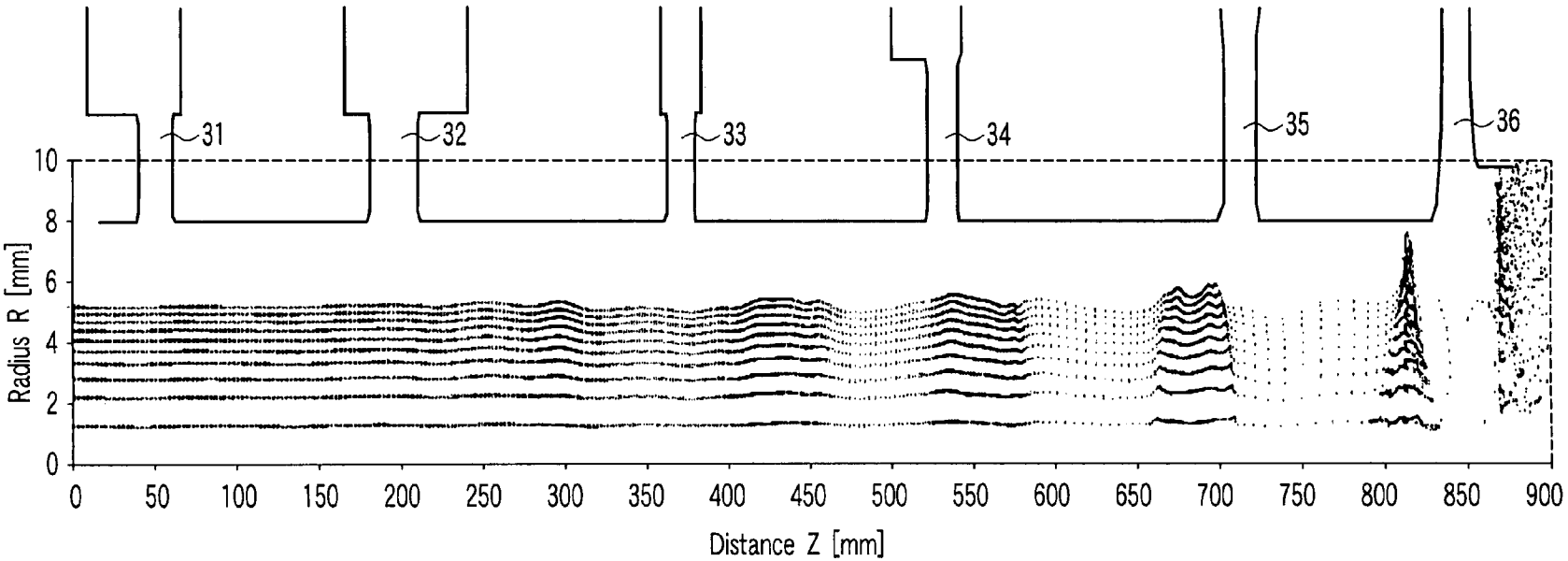
FIG. 8 is a diagram for explaining the result of analyzing the operation in the case where a magnetic field having a constant axial magnetic flux density is applied to the multi-beam klystron apparatus having no radio-frequency interaction unit pole piece as a comparative example.

FIG. 8 shows, as a comparative example, the result of analyzing the operation of the multi-beam klystron apparatus having no radio-frequency interaction unit pole piece 52 to which a magnetic field having a constant magnetic flux density is applied. The abscissa represents the axial distance Z, and the ordinate the radius R from the center of the electron beam. The radial direction is shown in a scale about 20 times larger than the axial direction. The dotted lines up to 2.5 scale units from the center in radial direction indicate the electron beams. It is confirmed that the electron beams are equidistant in axial direction in the neighborhood of the input cavity 31, while the density difference of the electron beam is increased in axial direction and the electrons (electron beams) are bunched in the neighborhood of the output cavity 36. At the same time, the spread in radial direction is confirmed. Especially, the electron beams are liable to collide with the drift tubes 30 before the output cavity 36.

Figure 7:
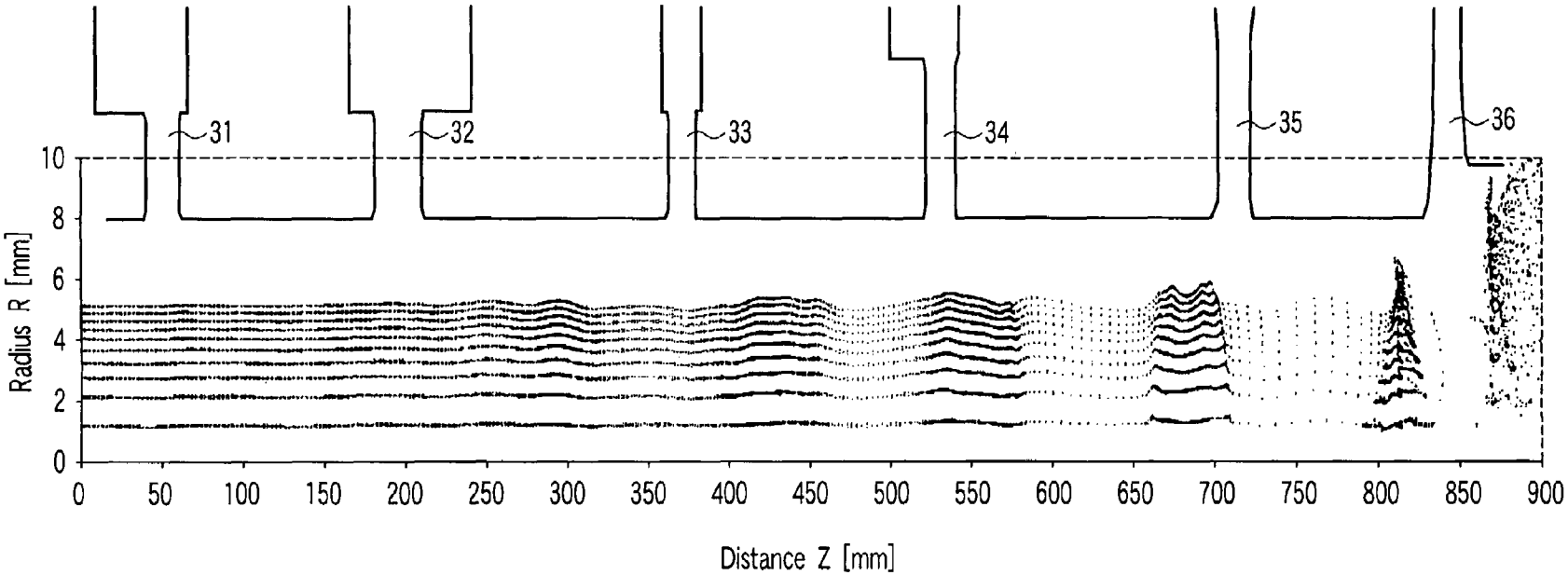
FIG. 7 is a diagram for explaining the result of analyzing the operation of the same multi-beam klystron apparatus.

FIG. 7 shows the result of analyzing the operation of the multi-beam klystron apparatus 11 having the radio-frequency interaction unit pole piece 52. The conditions other than the magnetic flux density are the same as those in FIG. 8. It is confirmed that the spread of the electron beams immediately before the output cavity 36 is smaller than in FIG. 8.

As described above, by arranging the radio-frequency interaction unit pole piece 52 between the output-side magnetic field generator 44 and the main magnetic field generator 40, the magnetic circuit formed in the neighborhood of the output cavity 36 of the radio-frequency interaction unit 19 can be separated. Therefore, the axial magnetic flux density in the neighborhood of the output cavity 36 can be increased without curving the electron beams, thereby making it possible to prevent the spread of the electron beams in the neighborhood of the output cavity 36.

Figure 9:
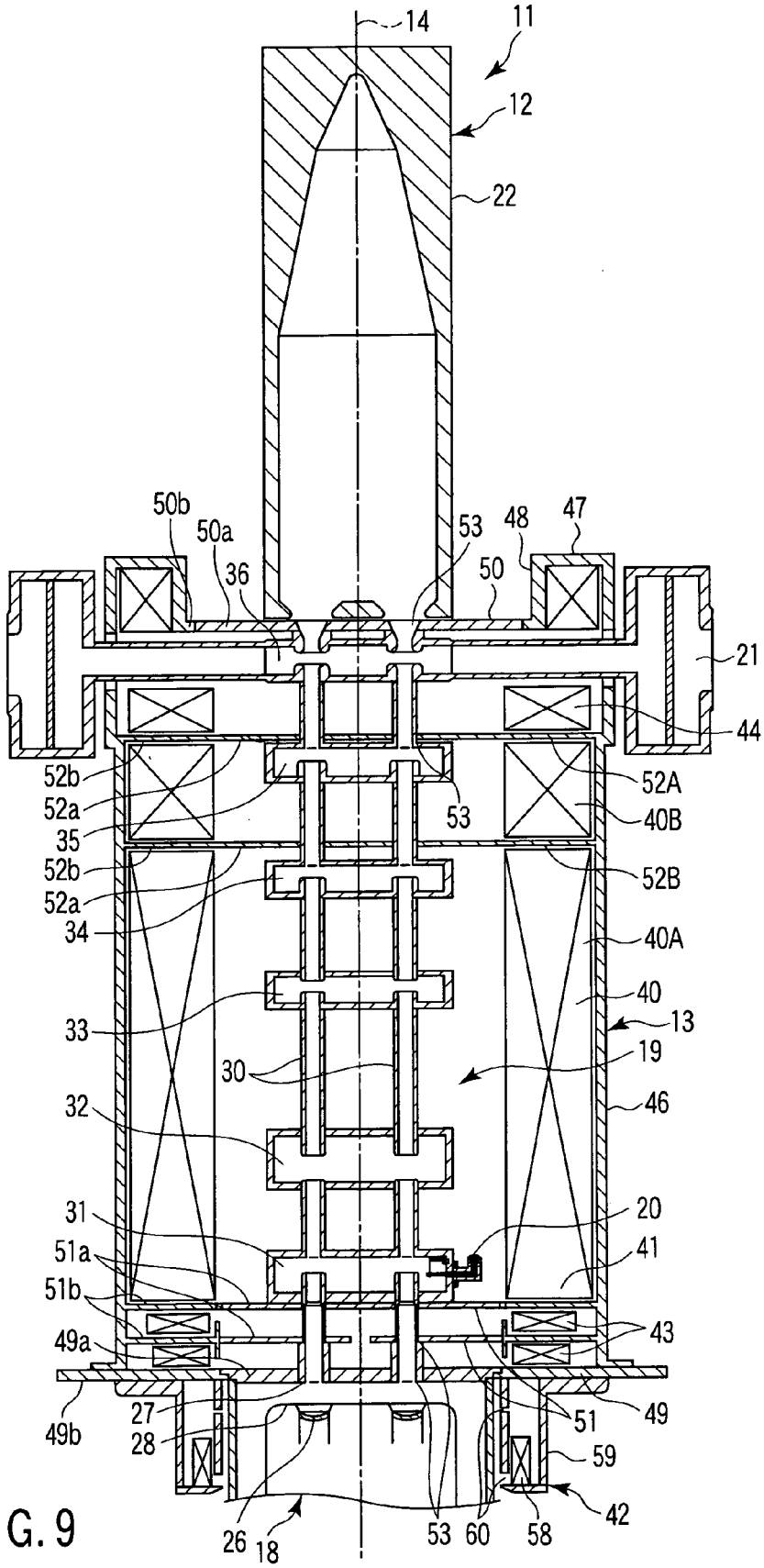
FIG. 9 is a sectional view of the multi-beam klystron apparatus according to a second embodiment of the invention.
Figure 10:
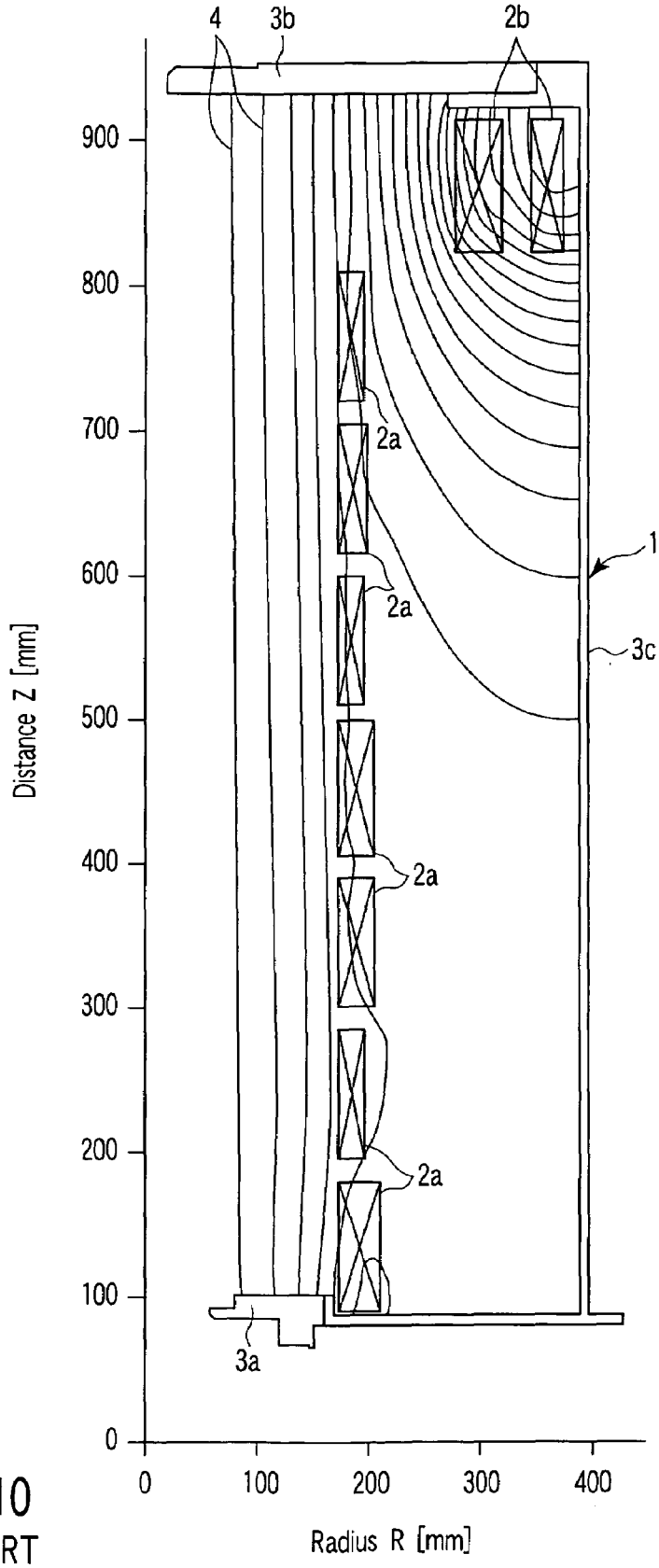
FIG. 10 PRIOR ART
FIG. 10 is a diagram for explaining the result of analyzing the lines of magnetic force of the focusing magnetic field unit of the conventional single-beam klystron apparatus.
Figure 11:
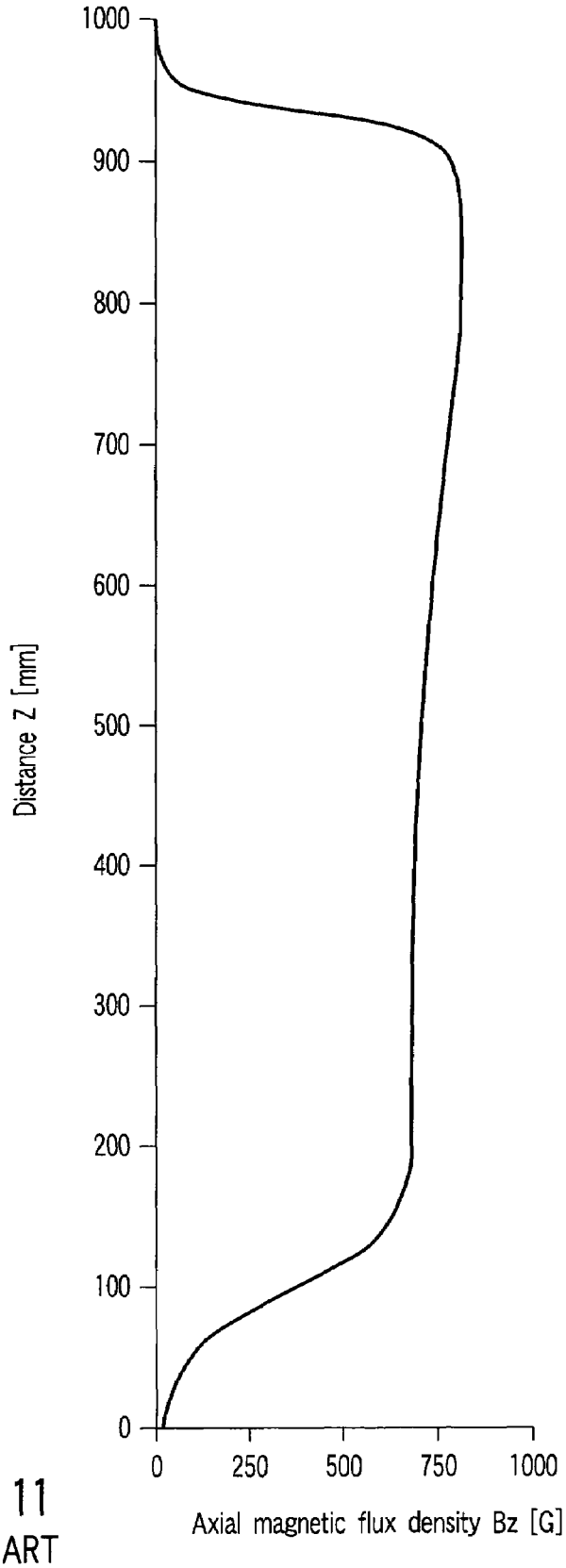
FIG. 11 PRIOR ART
FIG. 11 is a graph showing the relation between the axial magnetic flux density and the axial position from the cathode of the electron gun unit of the conventional single-beam klystron apparatus.
Figure 12:
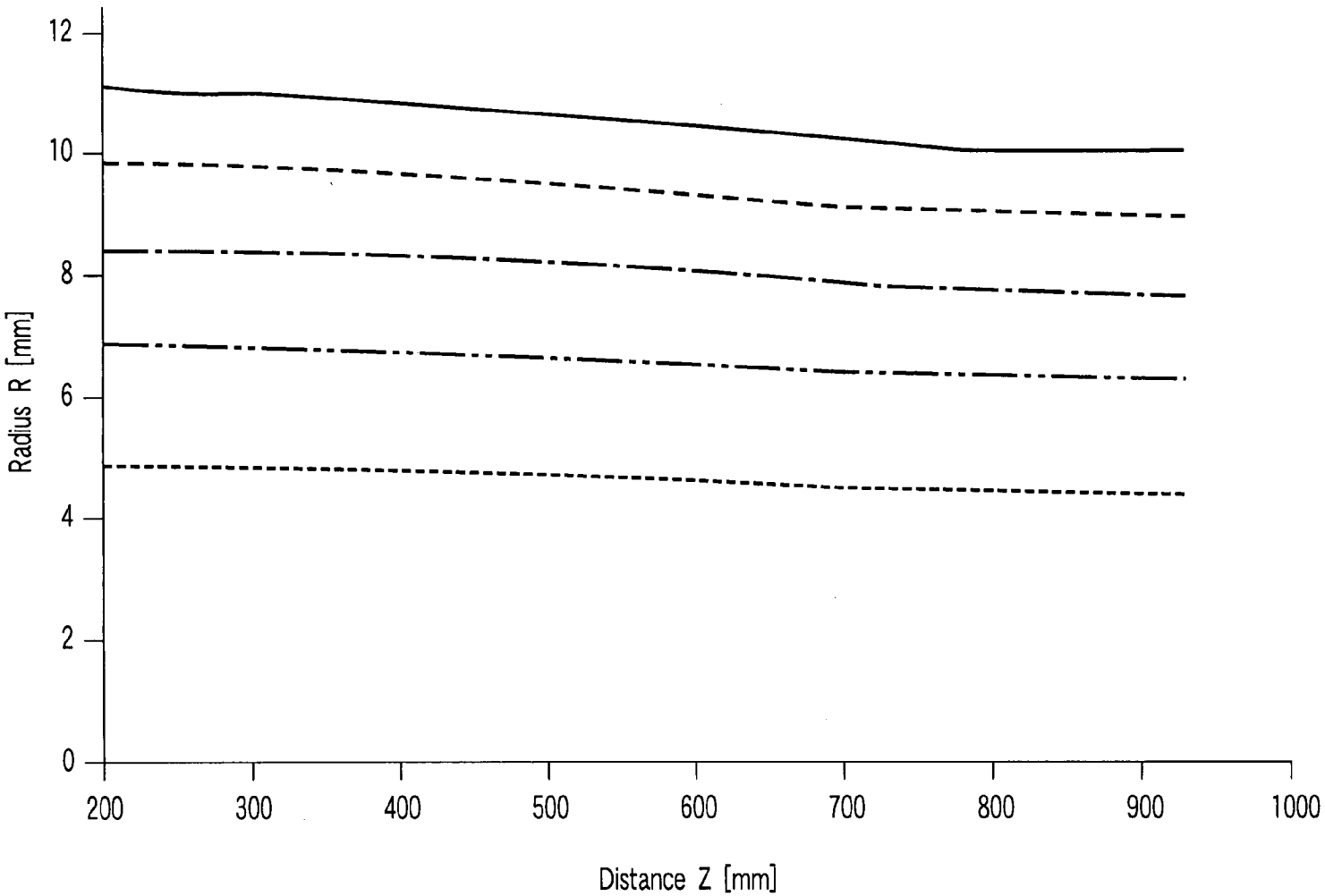
FIG. 12 PRIOR ART
FIG. 12 is a graph showing the relation between the axial position from the cathode of the conventional electron gun unit and the lines of magnetic force in the neighborhood of the center axis.
Figure 13:
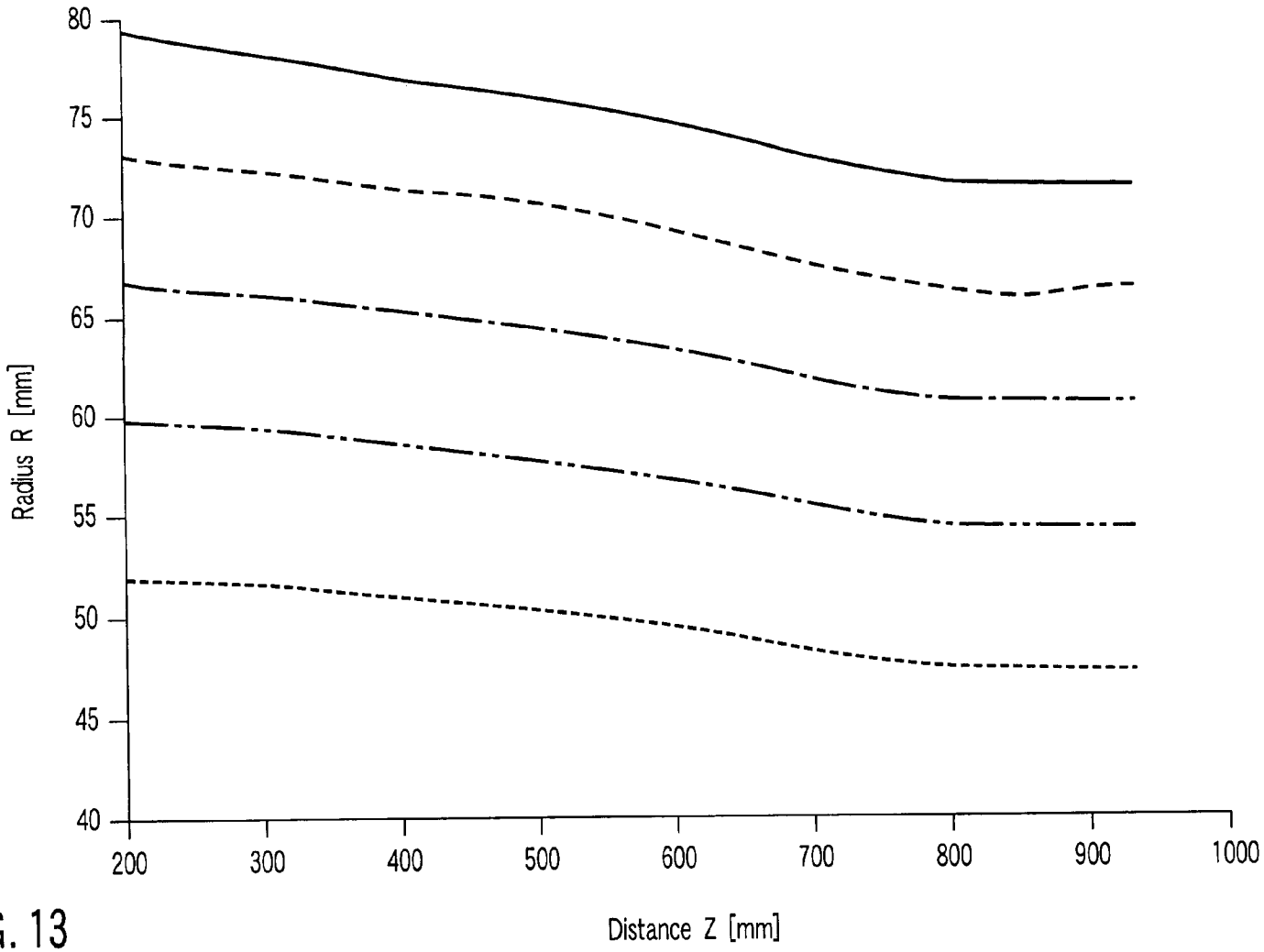
FIG. 13 PRIOR ART
FIG. 13 is a graph showing the relation between the axial position (distance Z) from the cathode of the electron gun unit of a multi-beam klystron apparatus and the lines of magnetic force at the position (radius R) from the center axis of the klystron body in the neighborhood of each electron beam.

FIG. 9 shows a second embodiment. The same component parts as those in the first embodiment are designated by the same reference numerals, respectively.

The main magnetic field generator 40 is separated into a main magnetic field generator 40A arranged on the outside of the input cavity 31 to the intermediate cavities 32, 33, 34 except for the intermediate cavity 35 near to the output cavity 36 on the one hand and a main magnetic field generator 40B arranged on the outside of the intermediate cavity 35 near to the output cavity 36.

The radio-frequency interaction unit pole piece 52 is configured of a radio-frequency interaction unit pole piece 52A arranged between the main magnetic field generator 40 and the lateral magnetic field-suppressing magnetic field generator 41 on the one hand and the intermediate cavity 35, the output-side magnetic field generator 44 and the output cavity 36 on the other hand, and a radio-frequency interaction unit pole piece 52B arranged between the separated main magnetic field generators 40A and 40B.

The main magnetic field generator 40A generates a magnetic field parallel to the center axis 14 in the area from the input cavity 31 to the intermediate cavities 32, 33, 34, while the main magnetic field generator 40B generates a magnetic field parallel to the center axis 14 in the area of the intermediate cavity 35 near to the output cavity 36.

According to this embodiment, the electron beams are progressively bunched in the radio-frequency interaction unit 19 of the multi-beam klystron apparatus 11, and in order to prevent the gradual spread of the electron beams, the magnetic flux density distribution can be increased progressively as the electron beams proceed downstream.

As an alternative, the main magnetic field generator 40 may be separated into three or more parts on the output cavity 36 side, and three or more radio-frequency interaction unit pole pieces 52 may be arranged correspondingly.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A multi-beam klystron apparatus comprising:

an electron gun unit which generates electron beams from a plurality of points;

an input unit which inputs radio-frequency power;

a radio-frequency interaction unit which includes, from the electron gun unit side, an input cavity, a plurality of intermediate cavities and an output cavity, and amplifies the radio-frequency power input from the input unit to the input cavity by the interaction between the electron beams generated in the electron gun unit and a radio-frequency electric field;

an output unit which outputs the radio-frequency power from the output cavity of the radio-frequency interaction unit;

a collector unit which captures the electron beams passing through the radio-frequency interaction unit; and a focusing magnetic field unit which focuses the electron beams generated by the electron gun unit, the focusing magnetic field unit including: a main magnetic field generator arranged on the outside of the input cavity and the intermediate cavities of the radio-frequency interaction unit; an output-side magnetic field generator arranged on the outside of the output cavity of the radio-frequency interaction unit; an electron gun-side pole piece arranged between the radio-frequency interaction unit and the electron gun unit; a collector-side pole piece arranged between the radio-frequency interaction unit and the collector unit; and a radio-frequency interaction unit pole piece arranged between the output-side magnetic field generator and the main magnetic field generator.

2. The multi-beam klystron apparatus according to claim 1, wherein lines of magnetic force generated by the main magnetic field generator and lines of magnetic force generated by the output-side magnetic field generator have the same direction.

3. The multi-beam klystron apparatus according to claim 2, wherein the main magnetic field generator is separated into a part corresponding to the intermediate cavity arranged near to the output cavity and a part corresponding to the other intermediate cavities, and the radio-frequency interaction unit pole piece is arranged between the output-side magnetic field generator and the main magnetic field generator and between the separated parts of the main magnetic field generator.

4. The multi-beam klystron apparatus according to claim 1, wherein the main magnetic field generator is separated into a part corresponding to the intermediate cavity arranged near to the output cavity and a part corresponding to the other intermediate cavities, and the radio-frequency interaction unit pole piece is arranged between the output-side magnetic field generator and the main magnetic field generator and between the separated parts of the main magnetic field generator.

* * * * *